US007009469B2

(12) United States Patent
McCandless

(10) Patent No.: US 7,009,469 B2
(45) Date of Patent: Mar. 7, 2006

(54) COMPACT WAVEGUIDE FILTER AND METHOD

(75) Inventor: Jay McCandless, Bellevue, WA (US)

(73) Assignee: Harris Corporation, Melbourne, FL (US)

( * ) Notice: Subject to any disclaimer, the term of this patent is extended or adjusted under 35 U.S.C. 154(b) by 252 days.

(21) Appl. No.: 10/183,362

(22) Filed: Jun. 28, 2002

(65) Prior Publication Data

US 2004/0000973 A1 Jan. 1, 2004

(51) Int. Cl.
*H01P 1/20* (2006.01)

(52) U.S. Cl. ..... 333/208; 333/248

(58) Field of Classification Search ..... 333/208–218, 333/248
See application file for complete search history.

(56) References Cited

U.S. PATENT DOCUMENTS 2,129,712 A * 9/1938 Southworth ..... 455/39
2,617,881 A * 11/1952 Lewis et al. ..... 333/208
2,663,848 A * 12/1953 Lewis ..... 333/208
2,738,468 A * 3/1956 Miller ..... 333/208
2,773,244 A * 12/1956 Grieg ..... 333/208
2,849,689 A * 8/1958 Kock ..... 333/24.1
2,859,418 A 11/1958 Vogelman
2,866,595 A * 12/1958 Marie ..... 333/208
3,042,883 A * 7/1962 Pannenborg et al. ..... 333/110
4,218,666 A * 8/1980 Snyder ..... 333/211
4,675,631 A 6/1987 Waggett
4,725,798 A 2/1988 Igarashi
4,802,234 A * 1/1989 Tatomir et al. ..... 333/211
5,576,670 A * 11/1996 Suzuki et al. ..... 333/126
5,739,734 A * 4/1998 Chen et al. ..... 333/210
6,097,270 A * 8/2000 Yamanobe ..... 333/202
6,181,224 B1 1/2001 Glinder
6,232,853 B1 5/2001 Goulouev
6,285,267 B1 9/2001 Hauth et al.
6,340,922 B1 1/2002 Rust
6,535,083 B1 * 3/2003 Hageman et al. ..... 333/210
6,552,636 B1 * 4/2003 Yuanzhu ..... 333/249
6,583,683 B1 * 6/2003 Schubert et al. ..... 333/21 A
2003/0117243 A1 * 6/2003 Cooper ..... 333/208

OTHER PUBLICATIONS

European Search Report for EP03762230.5.

* cited by examiner

*Primary Examiner*—Robert Pascal
*Assistant Examiner*—Kimberly Glenn
(74) *Attorney, Agent, or Firm*—Mark C. Comtois; Duane Morris, LLP

(57) ABSTRACT

A compact multiple VSWR element filter in which one or more of the VSWR filter elements is a waveguide bend or a waveguide media transition. Methods are also disclosed.

16 Claims, 2 Drawing Sheets

COMPACT WAVEGUIDE FILTER AND METHOD

BACKGROUND OF THE INVENTION

The present invention relates to a waveguide filter and method. More specifically, the present invention relates to a filter utilizing common waveguide elements, i.e. bends and media transitions, as the filter elements.

Waveguides are elongated hollow structures used for directing a high-frequency electromagnetic signal. Generally, it is desirable that the band of frequencies exiting the waveguide be the same as the band of frequencies entering the waveguide and great pains are often taken to insure that any impedance caused by a change in the direction of the waveguide and/or a transition in the medium are minimized. However, filtering to remove superfluous frequencies is desirable in many instances, e.g., where the equipment generating the electromagnetic energy may not be capable of generating a band of only the desired frequencies, or where the electromagnetic energy is the output of a mixer.

Filters for waveguides are well known. Typically, a filter comprises a number of voltage standing wave ratio ("VSWR") elements having high reflection coefficients. When the elements are positioned approximately a half wavelength apart, a pair of elements creates a resonator that passes certain frequencies while rejecting others. A waveguide filter may require multiple resonators as a function of the amount of filtering being performed, i.e., the frequency response of each resonator is limited. In a typical millimeter wave filter, there are between five and nine, often seven, VSWR elements creating six resonators. Placing these in series along the axis of the waveguide typically results in a filter of approximately three inches in length, at about 38 GHz for example.

Where the electromagnetic energy is millimeter wave, size becomes very important. For example, it becomes problematic to enclose the transmitter and receiver in the same housing.

Other problems are encountered where the energy is being conveyed in a stripline on a printed circuit board and a media transition must be effected to mount the filter to the circuit board. Generally, compensation is provided for the impedance mismatch caused by the media transition requiring increasing the effective size of the filter.

Still other problems result from the presence of bends in the waveguide as may be required by the architecture of the system. Compensation for any bends in the waveguide increases the effective length thereof, making the size of the filter even more critical.

In one aspect, the filter of the present invention avoids the problems of the prior art filters through the utilization of common waveguide elements, i.e. bends and media transitions, as filter elements. The length of the filter may be reduced and the versatility of the filter increased by taking advantage of the characteristics of waveguide bends and media transitions and replacing the usual VSWR filter elements therewith. Additional size advantages are achieved by combining transitions and bends where the filter is attached to a printed circuit board and the use of bends, the existence of which is architecturally dictated, as filter elements.

It is accordingly an object of the present invention to obviate many of the above problems in the prior art and to provide a novel compact waveguide filter and method.

It is accordingly an object of the present invention to provide a novel waveguide filter and method that utilizes common waveguide elements as filter elements.

It is another object of the present invention to provide a waveguide filter and method for use with printed circuit boards.

It is yet another object of the present invention to provide a novel waveguide filter and method which facilitates the packaging of both transmitter and receiver into a common housing.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
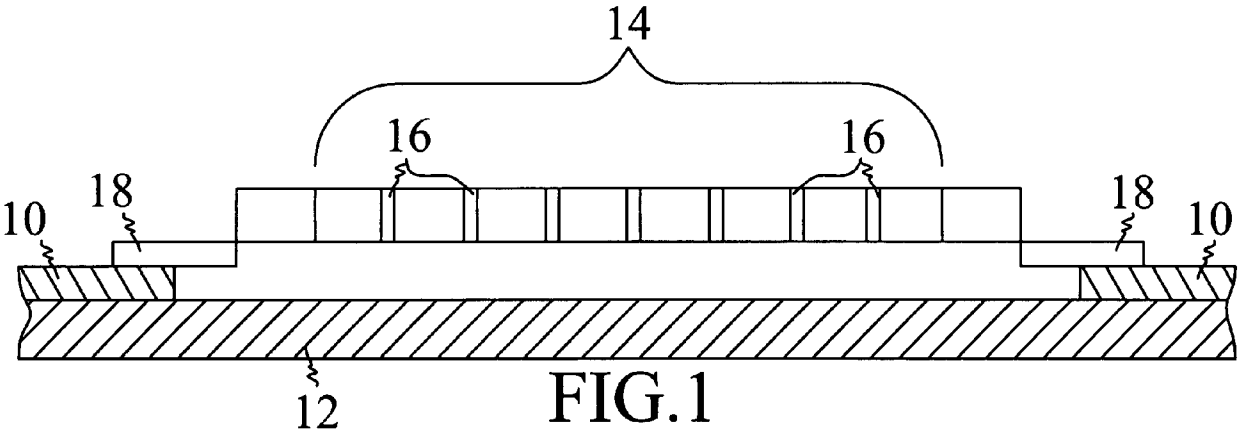
FIG.1 PRIOR ART
FIG. 1 is a schematic of a VSWR waveguide element filter of the prior art.

Referring to FIG. 1 where a stripline transmission line 10 is formed on the substrate 12 of a printed circuit board, a waveguide filter 14 is formed using seven known VSWR filter elements 16, the filter being connected to the stripline by conventional transitions 18. In the typical six resonator 38 GHz filter, the distance between the ends of the stripline transmission lines 10 may be approximately three inches.

Figure 2:
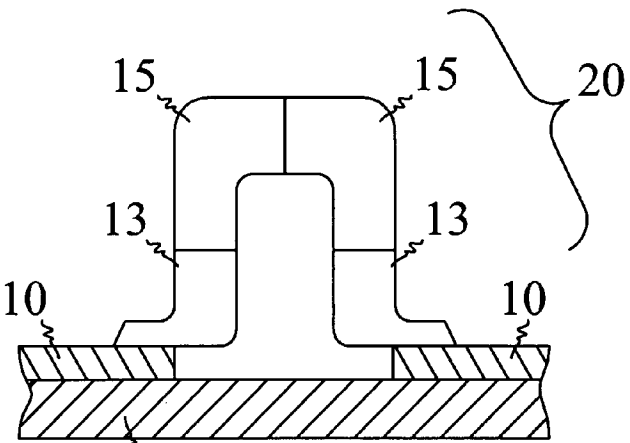
FIG. 2 is a schematic of a VSWR waveguide element filter, according to one embodiment of the present invention.

One embodiment of the compact waveguide filter of the present invention is illustrated in FIG. 2 where a stripline transmission line 10 is formed on the substrate 12 of a printed circuit board and the waveguide filter 20 is connected thereto. In the illustrated embodiment, the seven VSWRs of the filter of FIG. 1 and the two transitions are replaced by four elements and the total separation between the ends of the stripline transmission line 10 is reduced to less than one inch, for the same example.

As shown in FIG. 2, the filter 20 takes advantage of the impedance of the transitions 13 by using them as filter elements. The filter 20 also substitutes waveguide bends 15 for two of the VSWR elements in the filter of FIG. 1.

It should be recognized that the substitution of both bends 15 and transitions 13 for conventional VSWR elements can be done on a one for one basis in any combination. Thus a bend 15 dictated by the architecture may be made part of the filter, as may a media transition 13. The use of bends 15 is particularly advantageous in that surface area on the printed circuit board is conserved.

Figure 3:
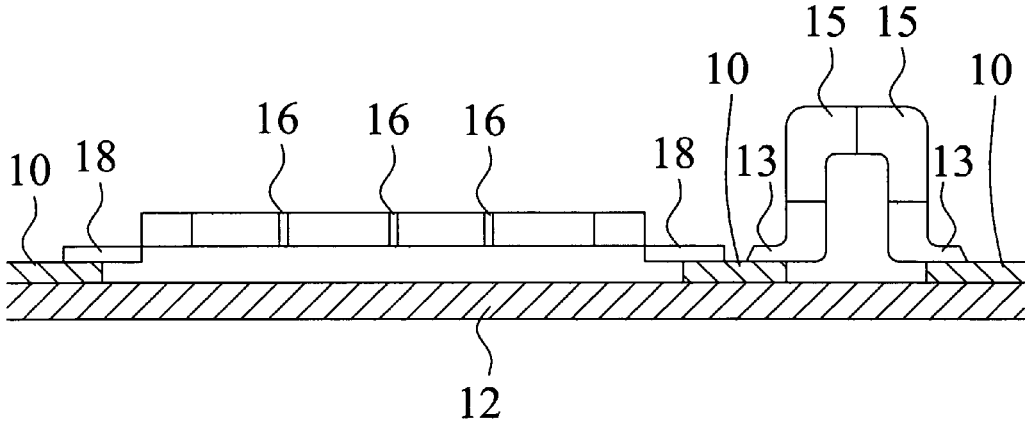
FIG. 3 is a schematic of a VSWR waveguide element filter, according to another embodiment of the present invention.

FIG. 3 is a schematic of a VSWR waveguide element filter, according to another embodiment of the present invention.

When the desirable frequencies of electromagnetic energy are known, filter characteristics and the number of resonators required may be determined. A filter of the present invention may thus be custom designed to fit a system's electrical and architectural requirements.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal thereof.

What is claimed is:

1. In an electromagnetic energy waveguide filter having a plurality of serially disposed VSWR waveguide elements, a method of reducing the axial length of the filter comprising the step of replacing at least one of said plurality of VSWR waveguide elements with a waveguide bend.

2. In an electromagnetic energy waveguide filter having a plurality of serially disposed VSWR waveguide elements, a method of reducing the axial length of the filter comprising the step of replacing at least one of said plurality of VSWR waveguide elements with a media transition.

3. The method of claim 2 including the further step of replacing at least one of said plurality of VSWR elements with a waveguide bend.

4. The method of claim 2 including the further steps of replacing two of said plurality of VSWR elements with waveguide bends.

5. In a waveguide including a waveguide bend and a multiple VSWR element waveguide filter, the improvement wherein said bend is an element of said VSWR filter.

6. In a waveguide including a media transition and a multiple VSWR element waveguide filter, the improvement wherein said media transition is an element of said VSWR filter.

7. In a filter adapted for multiple VSWR waveguide elements for passing electromagnetic energy of predetermined frequencies and having at least one VSWR waveguide element, the improvement additionally comprising a waveguide bend for passing electromagnetic energy of said predetermined frequencies.

8. The filter of claim 7 wherein said bend is in the E plane.

9. The filter of claim 8 wherein the number of elements is two.

10. The filter of claim 7 wherein said bend is in the H plane.

11. The filter of claim 7 wherein the number of elements is four.

12. In a filter adapted for multiple VSWR waveguide elements for passing electromagnetic energy of predetermined frequencies and having at least one VSWR waveguide element, the improvement additionally comprising a media transition for passing electromagnetic energy of said predetermined frequencies.

13. The filter of claim 12 wherein one media transition is between a waveguide and a microstrip.

14. The filter of claim 12 wherein the number of elements is two.

15. The filter of claim 14 wherein the filter is adapted to receive more than one VSWR elements and a waveguide bend.

16. In a multiple VSWR waveguide element filter that includes one media transition, the improvement wherein said media transition is used as one of said multiple VSWR elements.

* * * * *